US008298476B2

(12) United States Patent
Southall et al.

(10) Patent No.: US 8,298,476 B2
(45) Date of Patent: Oct. 30, 2012

(54) DUST COLLECTION SYSTEM FOR CALCINE TRANSFER CONTAINER

(75) Inventors: Sean David Southall, Acton (CA); Anthony Porretta, Brampton (CA); Weiguo Wang, Milton (CA); Michael Trovant, Toronto (CA)

(73) Assignee: Hatch Ltd., Mississauga (CA)

( * ) Notice: Subject to any disclaimer, the term of this patent is extended or adjusted under 35 U.S.C. 154(b) by 0 days.

(21) Appl. No.: 13/249,445

(22) Filed: Sep. 30, 2011

(65) Prior Publication Data

US 2012/0049420 A1 Mar. 1, 2012

Related U.S. Application Data

(63) Continuation of application No. PCT/CA2010/000472, filed on Apr. 1, 2010.

(60) Provisional application No. 61/166,220, filed on Apr. 2, 2009.

(51) Int. Cl.
*C21B 7/22* (2006.01)

(52) U.S. Cl. ..... 266/158; 266/144

(58) Field of Classification Search ..... 266/144, 266/158, 159

See application file for complete search history.

(56) References Cited

U.S. PATENT DOCUMENTS

| | | | | |
|---|---|---|---|---|
| 3,439,909 | A * | 4/1969 | Richards | 266/140 |
| 4,379,548 | A * | 4/1983 | Boshoven | 266/158 |
| 4,736,383 | A | 4/1988 | Meierling | |
| 6,953,337 | B2 | 10/2005 | McCaffrey | |

FOREIGN PATENT DOCUMENTS

| | | | |
|---|---|---|---|
| CA | 2222401 | A1 | 5/1999 |
| GB | 2059029 | A | 4/1981 |
| JP | 2004-361003 | A | 4/1988 |
| WO | WO 98/53106 | A1 | 11/1998 |

* cited by examiner

*Primary Examiner* — Scott Kastler
(74) *Attorney, Agent, or Firm* — K&L Gates LLP

(57) ABSTRACT

A system for controlling emissions of gas and dust during transfer of a hot feed material from a movable transfer container to a stationary feed bin of a furnace. The system includes an upper duct section which is associated with the movable transfer container, and a lower duct section associated with the feed bin. The lower duct section is attached to a main collection duct with a dust collection fan. The two duct sections are brought into close proximity with one another when the transfer container is brought into position for discharge to the feed bin, so as to form a continuous gas passage throughout the duct sections.

16 Claims, 8 Drawing Sheets

Fig. 6A
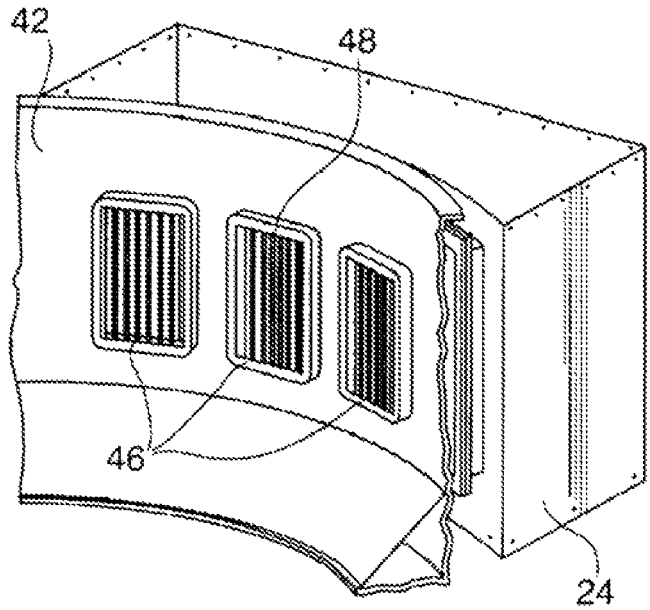
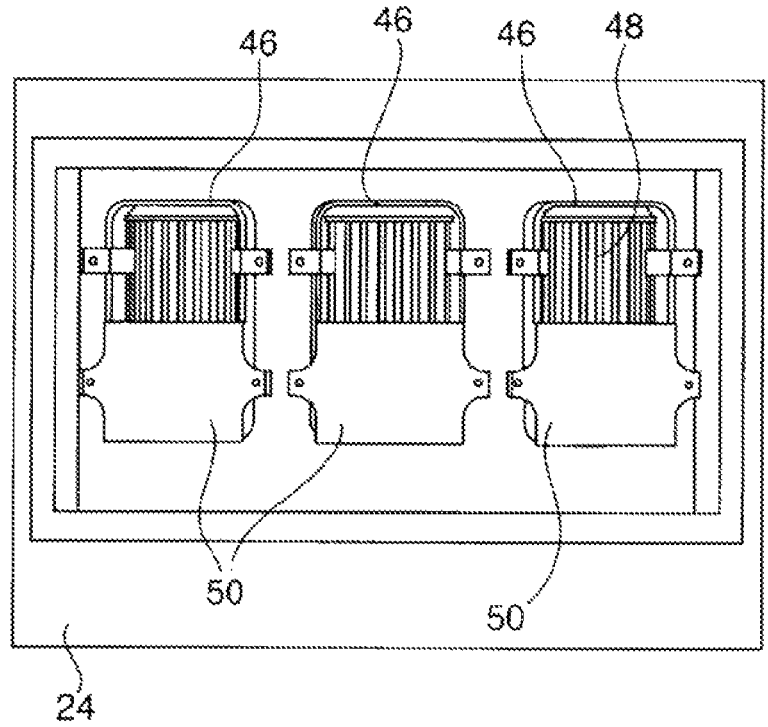
Fig. 6B

DUST COLLECTION SYSTEM FOR CALCINE TRANSFER CONTAINER

CROSS REFERENCE TO RELATED APPLICATIONS

This application is a continuation of International Application No. PCT/CA2010/000472, filed on Apr. 1, 2010, which claims the benefit of and priority to U.S. Patent Application No. 61/166,220, filed on Apr. 2, 2009, under the title "Dust Collection System for Calcine Transfer Container". The contents of the above applications are hereby expressly incorporated by reference into the detailed description hereof.

FIELD OF THE INVENTION

This invention relates to the capture of fume during transfer of hot feed materials from a preprocessing plant to an electric smelting or melting furnace. The preprocessing plant may be a kiln, a direct reduction facility, a rotary hearth furnace, or any other preprocessing plant in which an ore is calcined, sintered or reduced.

BACKGROUND OF THE INVENTION

A typical hot material transfer system used to transfer preprocessed furnace feed material might consist of the following sequence:

(a) A valve on the output end of a kiln discharges the hot feed material into a transfer container below, which is mounted on a transfer car.

(b) Once the transfer container has been filled, the transfer car travels into the furnace building with the full container, which is then picked up by the furnace-charging crane. The crane raises the transfer container to an elevation just above the top of the furnace feed bins, which are located directly above the furnace.

(c) The crane places the transfer container on a bin and the action of setting the container down causes it to discharge the feed material down into the bin.

The problems associated with the transportation of such hot feed materials arise from their inherent characteristics, which may include some or all of the following:

The materials are hot (up to 1000° C.), are normally abrasive and normally contain a significant amount of fines.

The hot feed materials are in a partially reduced state, and the reduction of the feed material continues as it is transferred from the kiln to the furnace feed bins. This causes a near constant but relatively benign and clean emission of CO gas. When the hot CO gas reaches air it further oxidizes to form $CO_2$. Once the hot feed materials are exposed to air they may begin to burn (reoxidize). This reaction releases more heat and a large volume of gas. This gas is a pollutant and usually carries particulate matter.

For these reasons transfer of hot feed materials is inherently a dirty and environmentally and occupationally detrimental process. Because the hot feed material is at an elevated temperature and contains reductant ingredients, hot gases (especially carbon monoxide) are continually emitted during the transfer, sometimes with inclusion of particulate matter.

Although such emissions are released throughout the entire time the transfer container contains the feed material, these emissions are relatively small compared to those released during the filling and emptying of the container. Of these processes, by far the largest burst of dirty emissions occurs during the emptying of the transfer container. This event has the highest degree of agitation and mixing of the feed material with air. The typical hot furnace feed transfer deposits a transfer container approximately every 10 minutes. Therefore, six or more of these "bursts" occur per hour, 24 hours per day, 50 weeks per year.

There are other known means for controlling dust and pollution during the transfer of hot feed materials. One example is disclosed by U.S. Pat. No. 6,953,337 (McCaffrey et al.), which is incorporated herein by reference in its entirety. According to McCaffrey et al., an enclosed housing with a controlled atmosphere is provided between the preprocessing plant and the furnace. The feed material is preferably raised within the housing to a higher level that that at which it is discharged from the plant so that it can be fed to inclined funnel assemblies which carry the feed material to the furnace by gravity.

There remains a need for an effective and economical system for reducing or eliminating emissions during transfer of hot feed materials, and in particular from the transfer container into the feed bins.

SUMMARY OF THE INVENTION

In one aspect, the invention provides a system for controlling emissions of gas and dust during transfer of a feed material from a transfer container to a feed bin of a furnace. The dust collection system comprises a first duct section and a second duct section. The first duct section is located in close proximity to a side wall of the transfer container, and comprises a first conduit and a lower dust collection fitting. The lower dust collection fitting has a lower intake port which is proximate to a bottom opening of the transfer container. The first conduit has an interior in communication with the lower intake port, and has an open end located proximate to the lower end of the transfer container. The second duct section is located in close proximity to the feed bin of the furnace, and comprises a second conduit having a inlet end with an inlet opening and an outlet end with an outlet opening. The inlet end of the second conduit is adapted to be in close proximity to the open end of the first conduit when the transfer container is in position to discharge the hot feed material into the feed bin, and with the inlet opening of the second conduit in communication with the open end of the first conduit, thereby forming a continuous gas flow passage from the lower intake port of the first duct section to the outlet end of the second duct section.

In another aspect, the first duct section further comprises an upper dust collection fitting having an upper intake port located proximate to a top opening of the transfer container, the upper dust collection fitting comprising a hood which is pivotable between a first position in which the hood covers the top opening of the transfer container with the upper intake port in substantial alignment with the top opening, and a second position in which the hood is in a non-obstructing position relative to the top opening of the transfer container.

In yet another aspect, the hood includes a sealing lid having a sealing element adapted to seal the top opening of the transfer container.

In yet another aspect, the sealing lid further comprises a heat shield which shields the sealing element from the conditions inside the transfer container, wherein the sealing element is adapted to permit outflow of gas from inside the transfer container while substantially preventing inflow of gas into the container.

In yet another aspect, the hood is pivotable about a horizontal axis located to one side of the top opening.

In yet another aspect, a pivoting connection is provided between the hood and the first conduit.

In yet another aspect, the first duct section is connected to the transfer container and wherein the first conduit extends along the sidewall of the transfer container with its open end being located proximate to the bottom opening of the transfer container.

In yet another aspect, the lower dust collection fitting comprises a shroud having a wall with an open top end and an open bottom end, wherein the wall of the shroud surrounds the bottom opening of the transfer container and is adapted enclose a space between the transfer container and the feed bin when the transfer container is in position to discharge the hot feed material into the feed bin, wherein the intake port of the lower dust collection fitting formed in the wall of the shroud and is in communication with the interior of the first conduit.

In yet another aspect, the wall of the shroud is cylindrical and is sealed along its open top end to the sidewall of the transfer container, and wherein the open bottom end is provided with an inwardly extending flange which is adapted to seal against an upper surface of the feed bin. The upper surface of the feed bin surrounds an inlet opening thereof.

In yet another aspect, the shroud is provided with a plurality of the lower intake ports, and wherein each of the lower intake ports is provided with a grating.

In yet another aspect, the open end of the first conduit is substantially coplanar with the bottom end of the shroud.

In yet another aspect, the bottom end of the shroud is provided with a flange which seals against the upper surface of the feed bin.

In yet another aspect, the outlet end of the second conduit is connected to a main collection duct.

In yet another aspect, the main collection duct extends alongside the feed bin in close proximity thereto, and wherein the second conduit extends vertically between its inlet end and its outlet end.

In yet another aspect, the second conduit is divided into two or more branches, each of which extends vertically alongside the feed bin.

In yet another aspect, the inlet end of the second conduit is substantially coplanar with a flat, planar surface surrounding an inlet opening of the feed bin which comes into engagement with the bottom end of the shroud when the transfer container is in position to discharge the hot feed material.

In yet another aspect, the first duct section and/or the second duct section are constructed so as to leave a gap between the open end of the first conduit and the inlet opening of the second duct section. The gap may have a size of less than about 1 inch.

In yet another aspect, one or both of the first duct section and the second duct section are provided with an extension portion to adjust the size of the gap.

BRIEF DESCRIPTION OF THE DRAWINGS

Certain embodiments of the invention will now be described, by way of example only, with reference to the accompanying drawings in which:

FIGS. 6A and 6B are partial perspective views showing the intake ports proximate to the bottom opening of the transfer container;

DETAILED DESCRIPTION

The invention provides a system for controlling emissions of gas and dust during transfer of a hot feed material from a movable transfer container to a stationary feed bin of a furnace. The system comprises a collection of ductwork and devices and that are designed to capture emissions during discharge of the transfer container. The ductwork includes an upper duct section which is associated with the movable transfer container itself, as well a lower duct section which is associated with the feed bin of the furnace. The two duct sections are brought into close proximity with one another when the transfer container is brought into position for discharge to the feed bin, so as to form a continuous gas passage extending throughout the duct sections. Once the two duct sections are brought into engagement, a dust collection fan is turned on, causing dust and fume to be drawn out to a treatment center as the transfer container begins its bottom discharge. The system according to the invention can be applied to new smelting furnaces being built or retrofitted to improve existing smelting furnaces.

Embodiments of the invention are now described below with reference to the drawings. In the following description, the hot feed material is a calcined, sintered or reduced ore which is produced in a preprocessing plant such as a kiln, a direct reduction facility, or a rotary hearth furnace, and is sometimes referred to as "calcine".

Figure 1:
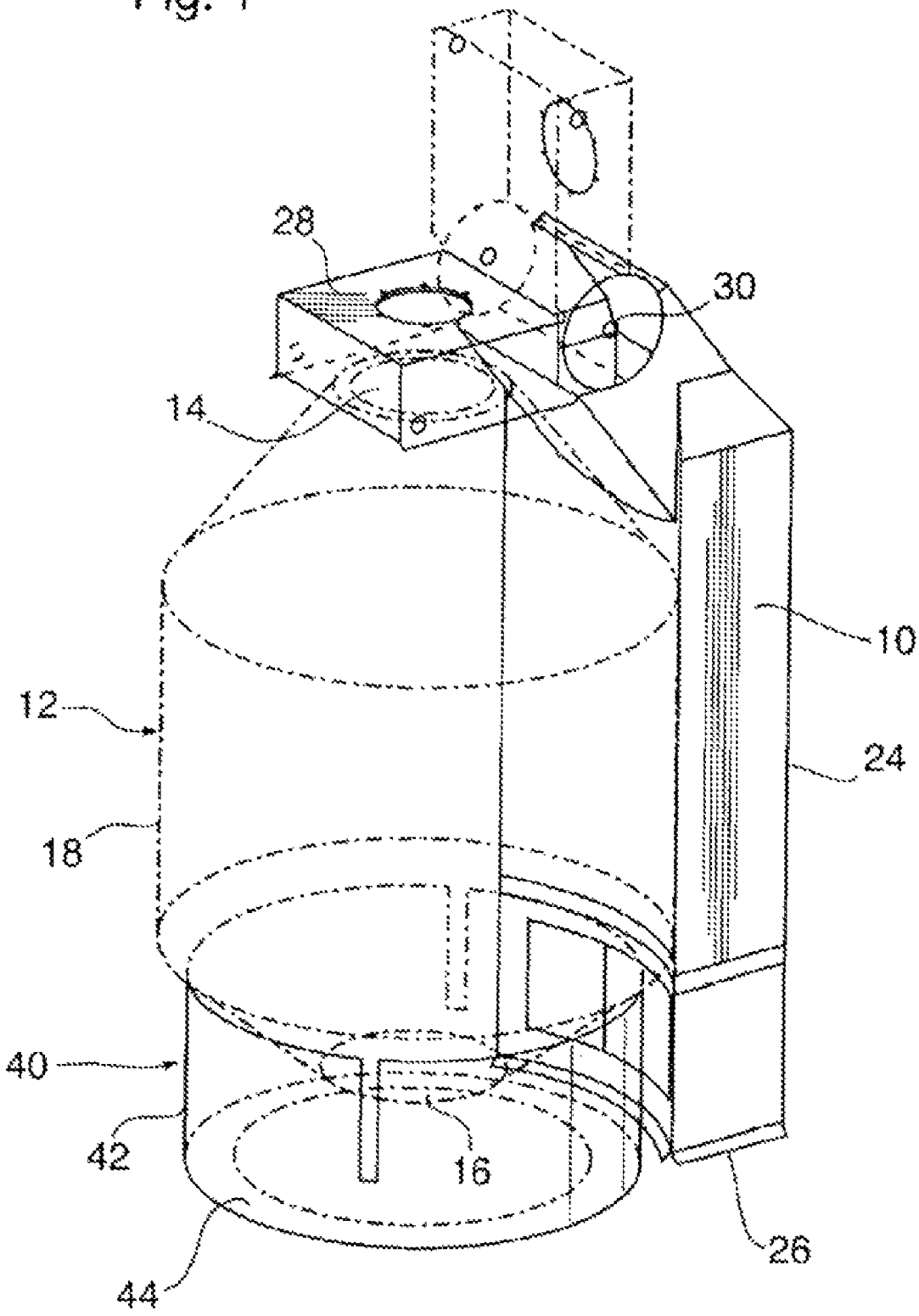
FIG. 1 illustrates an upper duct section of a dust collection system according to a first embodiment of the invention, shown in relation to a transfer container.

FIG. 1 illustrates the upper duct section 10 of a dust collection system according to a first embodiment of the invention, shown in relation to a transfer container 12 having a top opening 14 located at its upper end, a bottom opening 16 located at its lower end, and a sidewall 18 extending between the upper and lower ends. The sidewall 18 is shown as being tapered toward the top and bottom openings 14, 16. The transfer container 12 is shown in dashed lines and all unnecessary detail has been omitted therefrom. A hot feed material 13 (FIG. 3) is received from the preprocessing plant (not shown) through the top opening 14 and is discharged by gravity through the bottom opening 16, as further described below.

As shown, the upper duct section 10 is located in close proximity to the transfer container 12, and may be attached to the sidewall 18 thereof. The upper duct section 10 comprises at least one dust collection fitting having one or more intake ports which are proximate to the top opening 14 and/or the bottom opening 16 of the transfer container 12. In the first embodiment shown in FIGS. 1-8, the upper duct section 10 comprises a pair of dust collection fittings, described in detail below.

The upper duct section 10 further comprises a first conduit 24 having a hollow interior in communication with the intake openings of the dust collection fittings, and having an open end 26 (shown in FIGS. 4 and 7) located proximate to the lower end of the transfer container 12.

Figure 5:
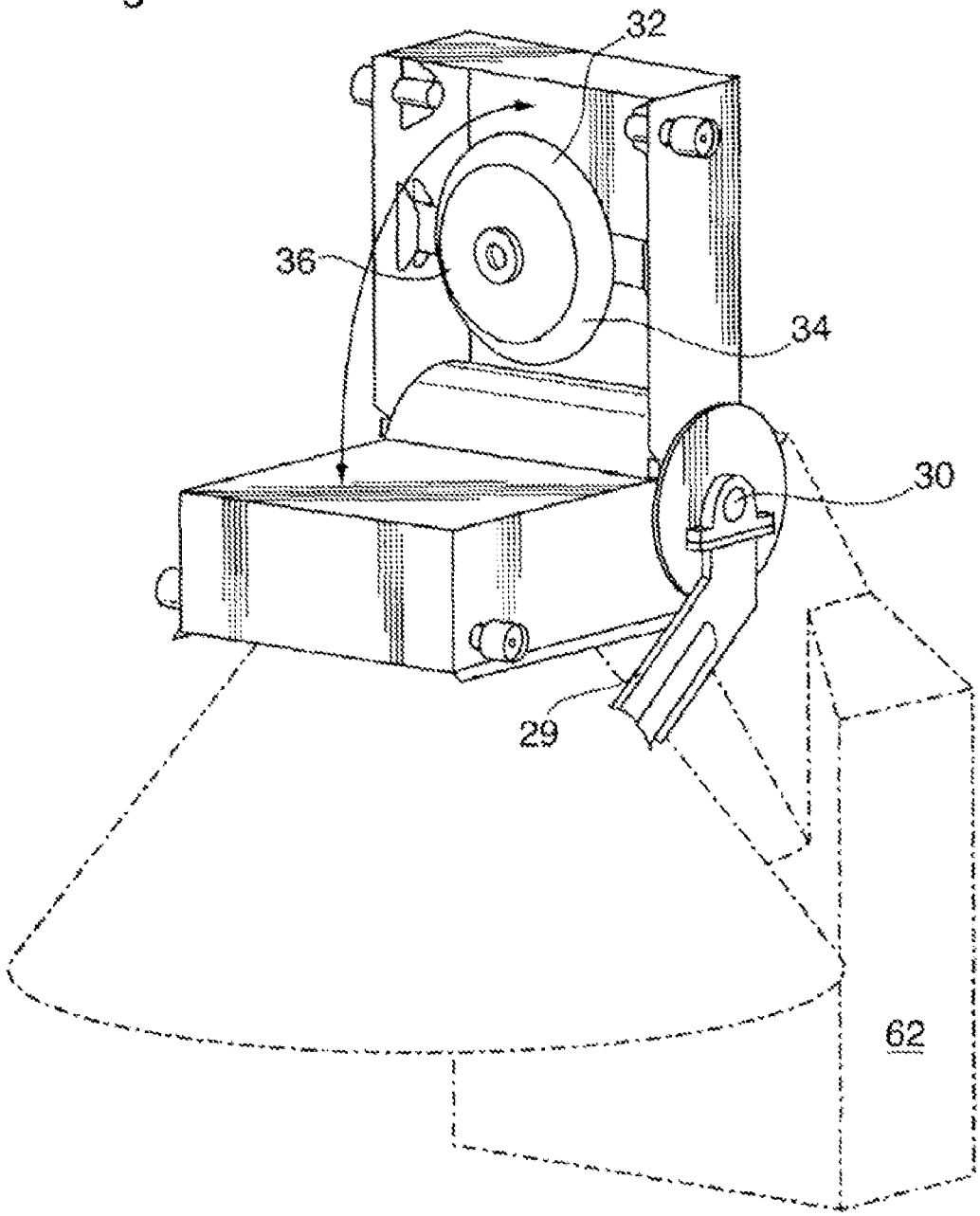
FIG. 5 is an enlarged view of the pivoting hood structure shown in FIG. 1.

The upper duct section 10 of the illustrated embodiment includes a first dust collection fitting in the form of a pivoting hood 28. The hood 28 shown in FIG. 1 (in solid lines) in a lowered position in which it covers the top opening 14 of the transfer container 12, and in dotted lines in a raised position in which it does not obstruct the top opening 14. The hood 28 is raised during filling of the transfer container 12 with the hot feed material, and is lowered to permit capture of dust and fumes during emptying of the transfer container 12. The hood is pivotable about a horizontal axis 30 located to one side of the top opening 14, and the pivoting connection is preferably provided between the hood 28 and the first conduit 24. The hood may be connected to the transfer container 12 by connecting arms 29 (FIG. 5).

Received inside the hollow interior of the pivoting hood 28 is a sealing lid 32 which seals the edges of the top opening 14 in the manner shown in FIG. 6. The sealing lid 32 comprises a pair of concentric discs, a larger disc 34 comprising a sealing element which forms a seal against the upper surface of the top opening, and a smaller disc 36 which is received inside the top opening 14 and acts as a heat shield. The discs 34, 36 are received on a link pin 38 which connects the discs 34, 36 to the inside of the hood 28. Thus, lowering of the hood 28 causes the top opening 14 to be closed by the sealing lid 32, while raising of the hood 28 moves the sealing lid 32 away from the opening 14. The hood 28 is lowered after filling of the transfer container 12, so that the top opening 14 is closed by the sealing lid 32 during transfer and emptying of the container 12.

The first conduit 24 may extend vertically along the sidewall 18 of the transfer container 12, and has an angled portion following the inward taper at the upper end of the transfer container, so as to reduce the flow turning angle within the conduit 24. Also, the conduit 24 may be provided with a curved inner surface to conform to the shape of the cylindrical sidewall of the transfer container. It will be appreciated, however, that the specific shape and configuration of the first conduit is variable, partly depending on the shape of the transfer container 12. The open end 26 of the first conduit 24 is located at its lower extremity.

The upper duct section 10 of the illustrated embodiment also includes a second dust collection fitting having at least one intake opening located proximate to the bottom opening 14 of the transfer container 12. The second dust collection fitting comprises a shroud 40 having a wall 42 with an open top end and an open bottom end. In the embodiment shown in the drawings, the shroud 40 is cylindrical, but it will be appreciated that the shape of shroud 40 may vary, depending on the shape of the transfer container 12. The wall of the shroud 40 surrounds the bottom opening 14 of the transfer container 12 and, as described below in greater detail, forms a seal between the transfer container 12 and the feed bin in order to trap dust and fumes being emitted during discharge of the transfer container 12. The shroud 40 may be sealed along its open top end to the tapering portion of the sidewall 18 of transfer container 12. The bottom end of the wall 42 may have an inwardly extending flange 44 to seal against the top of the feed bin, as described below.

The wall 42 of shroud 40 has at least one intake port and, in the illustrated embodiment, three intake ports 46 are provided. These are best seen in FIGS. 6A and 6B. The intake ports 46 may be provided with grating 48 (FIG. 6A) to prevent solid material from entering the duct 10, and adjustable cover plates 50 (FIG. 6B) may be provided to adjust the open area of the intake ports 46, so as to balance the gas flow through ports 46 relative to the flow through the pivoting hood 28.

Figure 2:
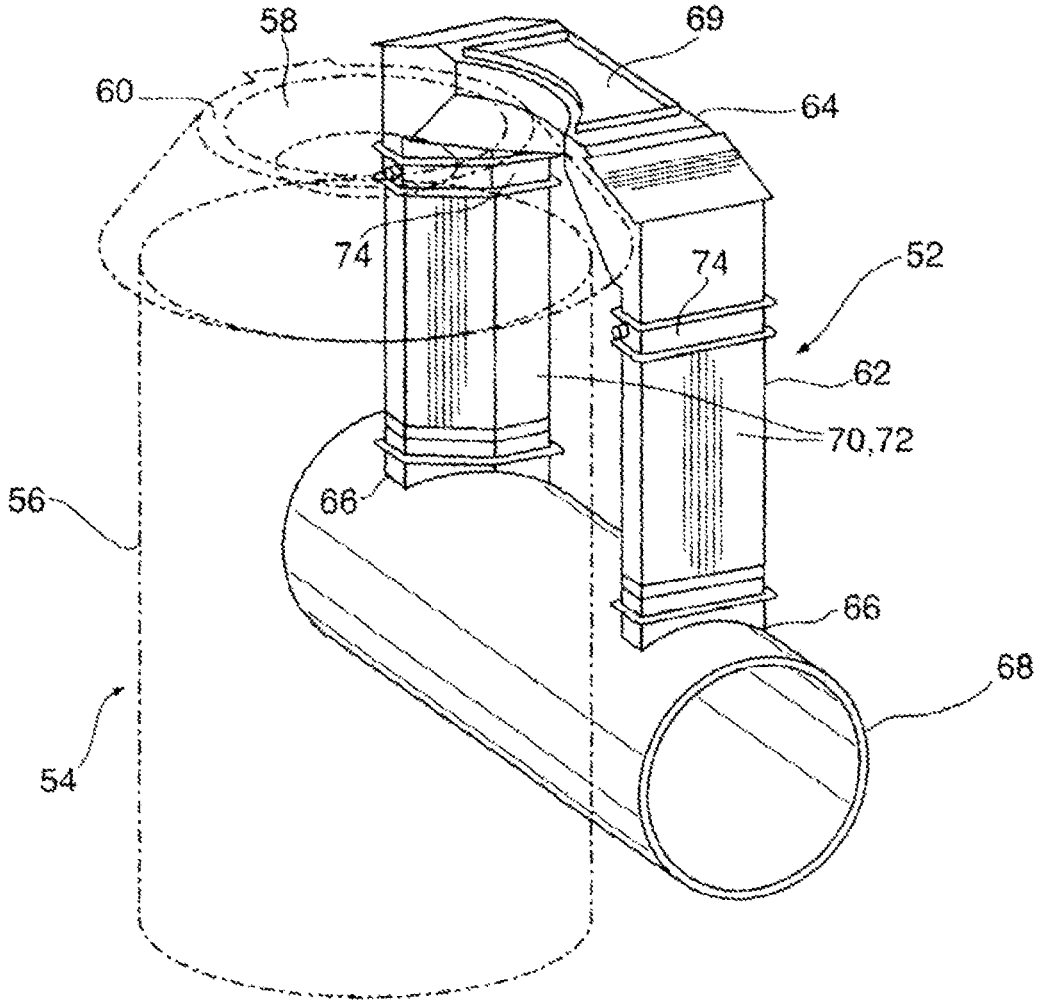
FIG. 2 illustrates a lower duct section of the dust collection system according to the first embodiment of the invention, shown in relation to the feed bin of a furnace.

FIG. 2 illustrates a lower duct section 52 of the dust collection system according to the first embodiment of the invention, shown in relation to a stationary feed bin 54 of a furnace, such as an electric melting or smelting furnace (not shown). The feed bin 54 is shown in FIG. 2 as being generally cylindrical in shape, having a sidewall 56 (or a cover therefor) which tapers inwardly at its upper end, at which an inlet opening 58 is provided to receive the hot feed material from the transfer container 12. The inlet opening 58 may be surrounded by a flange 60 as shown in FIG. 2. The flange 60 is also referred to herein as the "upper surface" of the feed bin 54, and although it is shown in the drawings as being flat and planar, this is not necessarily the case. The feed bin 54 is shown in dashed lines in FIG. 2 and all unnecessary detail has been omitted therefrom.

As shown, the lower duct section 52 is located in close proximity to the feed bin 54, and may extend vertically along the sidewall 56 of the feed bin 54 and be attached thereto. The lower duct section 52 comprises a second conduit 62 having an upper end 64 and a lower end 66. The upper end 64 of second conduit 62 is located proximate to the upper end of the feed bin 54, and the lower end 66 of the second conduit may be connected to the main collection duct 68, which is shown as being located proximate to the lower end of feed bin 54. The main collection duct 68 may extend alongside the feed bin 54 in close proximity thereto, and may have a generally horizontal orientation.

The upper end of the lower duct section 52 has a single inlet opening 69 which is shaped and sized to align with the open end 26 of first conduit 24, as further described below. In order to better adapt to the relative positions of the feed bin 54 and the main collection duct 68, the portion of the lower duct section 52 extending downward from the upper end 64 is divided into two branch conduits 70, 72 which extend to the lower end 66 and connect to the sidewall of the main collection duct 68. The branch conduits 70, 72 and their outlets are preferably of the same size to provide an even distribution of exhaust gases. It will be appreciated that the lower duct section 52 is branched due to the close proximity of the main collection duct 68 and the feed bin 54. The need for branching may not exist where the main collection duct 68 is spaced apart from the feed bin 54 by a greater amount.

The lower duct section 52 may be provided with means to control the flow of gases through the system, such as a damper. In the embodiment shown in the drawings, each of the branch conduits 70, 72 is provided with a stationary damper 74 to control the flow of exhaust into the main collection duct 68.

Figure 3:
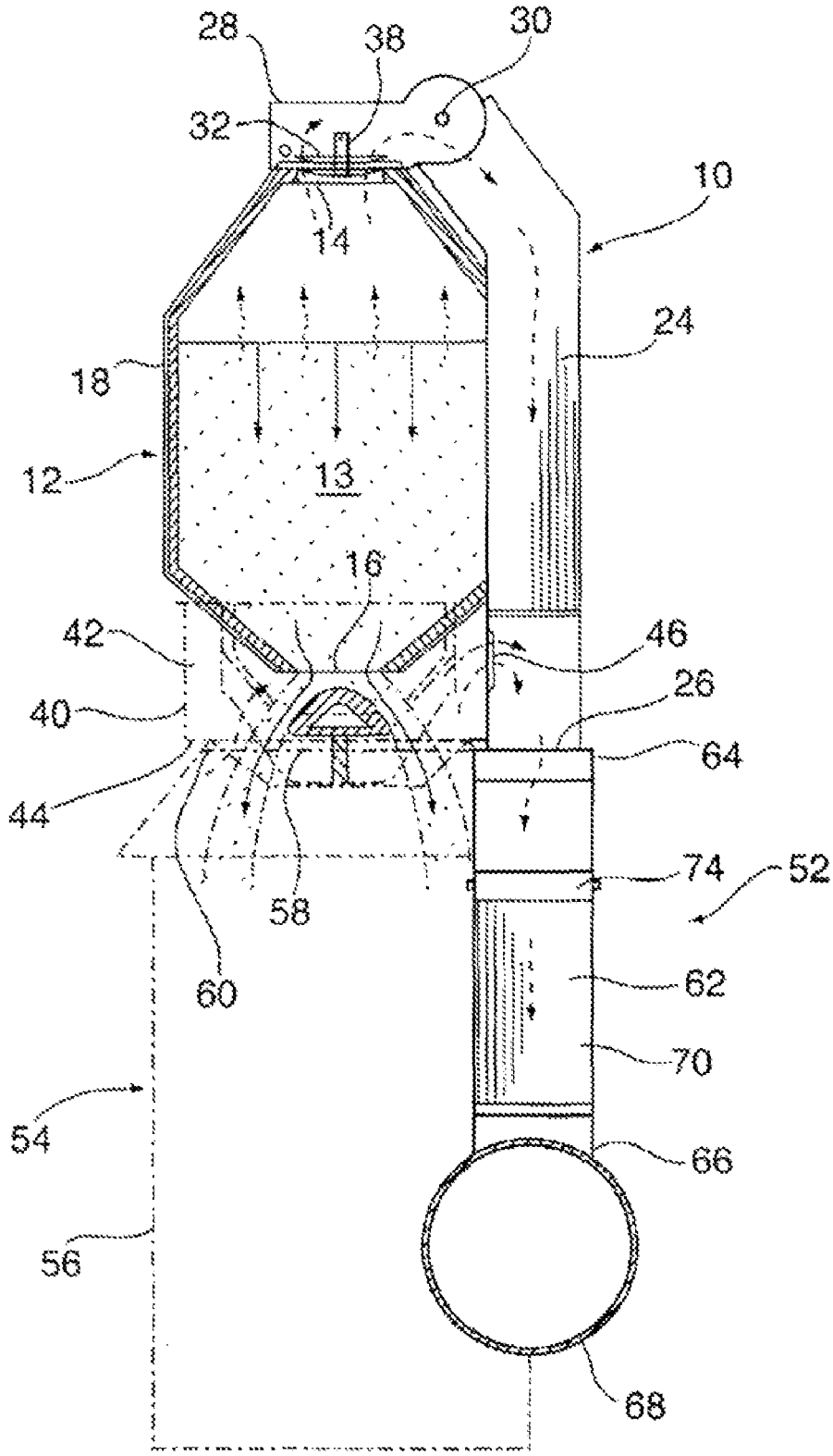
FIG. 3 is a side elevation view, partly in cross-section, showing the relative positioning of the upper and lower duct sections, the transfer container, and the feed bin during transfer of hot feed material to the feed bin.
Figure 4:
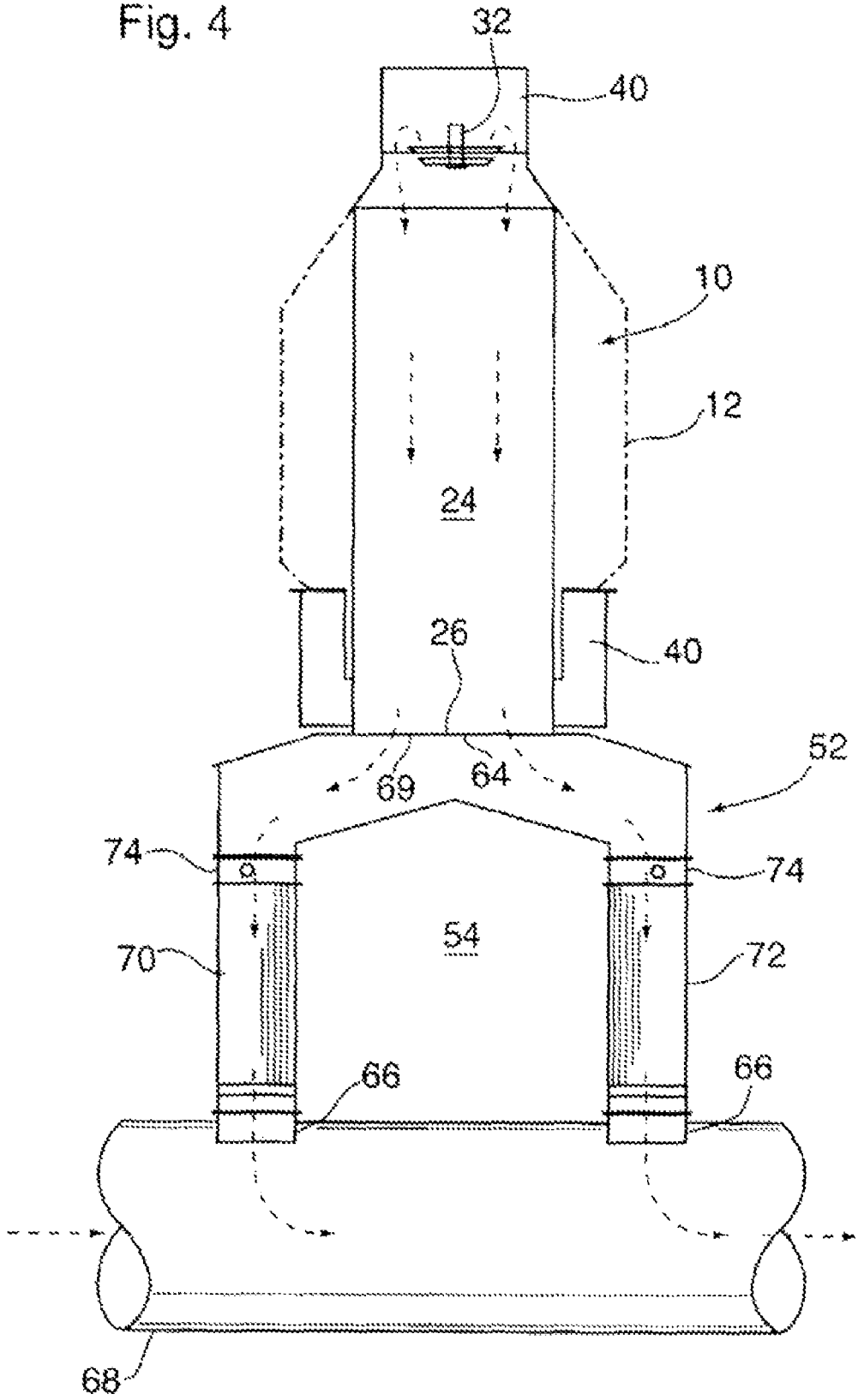
FIG. 4 is a rear elevation view of the arrangement shown in FIG. 3.

In order to discharge the hot feed material to the feed bin 54 the movable transfer container 12 is moved, along with the upper duct section 10, to the position shown in FIGS. 3 and 4. In this position, the bottom opening 16 of the transfer container 12 is vertically aligned directly over the inlet opening 58 of the feed bin 54 so that the hot feed material 13 will be discharged under gravity from the bottom opening 16 of the transfer container 12 into the inlet opening 58 of the feed bin 54, as indicated by the solid arrows in FIG. 3. The shroud 40 at the bottom of the transfer container 12 fits on top of the feed bin 54, with the flange 44 surrounding the bottom opening of the shroud 40 seating on the flange 60 surrounding the inlet opening 58 of the feed bin 54. Since the shroud 40 extends below the bottom opening 16 of the transfer container 12 a space is formed between the respective openings 16 and 58 of the transfer container 12 and the feed bin 54, the space being enclosed by the wall 42 of shroud 40 and being in communication with the intake ports 46.

When the transfer container 12 is brought into position for discharge to the feed bin 54, the upper and lower duct sections 10, 52 are brought into close proximity with one another to form a continuous gas passage extending throughout the duct sections 10, 52. Thus, the open end 26 of first conduit 24 and the upper end 64 of the second conduit 62 are brought into close proximity with one another when the shroud 40, or the flange 44 thereof, becomes seated on the upper end of the feed bin 54. Therefore, the upper end 64 of the lower duct section 52 may form a flat, planar connection surface which is substantially coplanar with the upper end of the feed bin 54 or, in the case of the illustrated embodiment, the flange 60 surrounding inlet opening 58. Also, the open end 26 of first conduit may form a flat, planar connection surface which is substantially coplanar with the bottom end of shroud 40 or, in the case of the illustrated embodiment, the flange 44. Also, the opening at the end 26 of first conduit 24 is in substantial alignment with the inlet opening 69 of the lower duct section 52.

Being ducts, the first conduit 24 and the second conduit 62 are constructed of lighter materials than the transfer container 12, the feed bin 54, and the shroud 40 on which the transfer container 12 is supported during emptying. To avoid crushing of the open end 26 of first conduit 24 and the upper end 64 of second conduit 62 when the transfer container 12 and feed bin 54 are brought together, it may be desired to construct conduits 24, 62 such that a slight gap is left between the open end 26 of the first conduit 24 and the upper end 64 of the second conduit 62 when the transfer container 12 is supported on the feed bin 54. The gap may be on the order of about 1 inch or less, and is therefore not visible in the drawings. The inventors have found that a gap of this size does not significantly impair the operation of the suction system.

Figure 7:
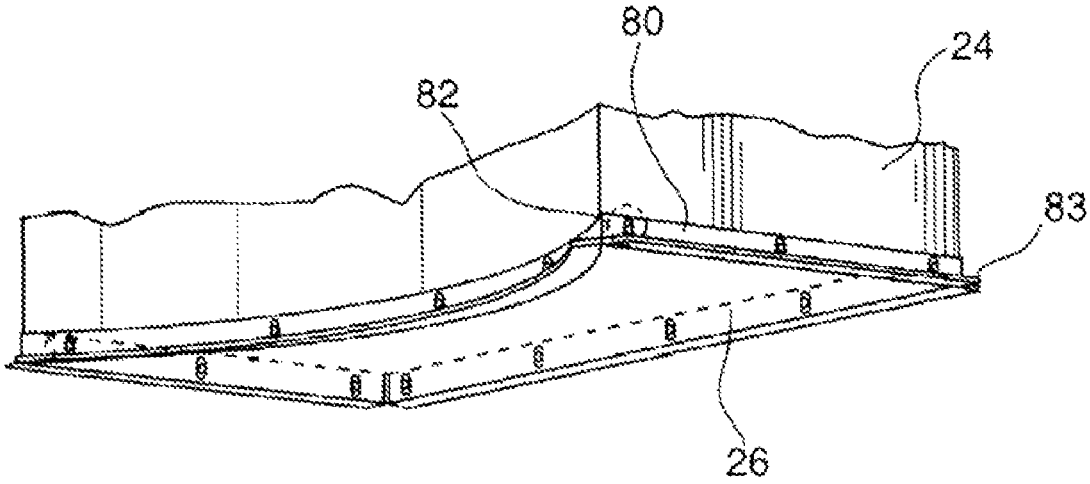
FIGS. 7 and 8 show the mating flanges surrounding the openings of the upper and lower duct sections.

In order to enable the size of the gap to be adjusted, the open end 26 of the first conduit 24 may be provided with an extension portion 80, shown in FIG. 7. The extension portion 80 is bolted to the first conduit 24 around the perimeter of open end 26, and is provided with slotted openings 82 to permit limited vertical movement of the extension portion 80. As shown in FIG. 7, the extension portion may include a horizontal, outwardly extending flange 83.

Figure 8:
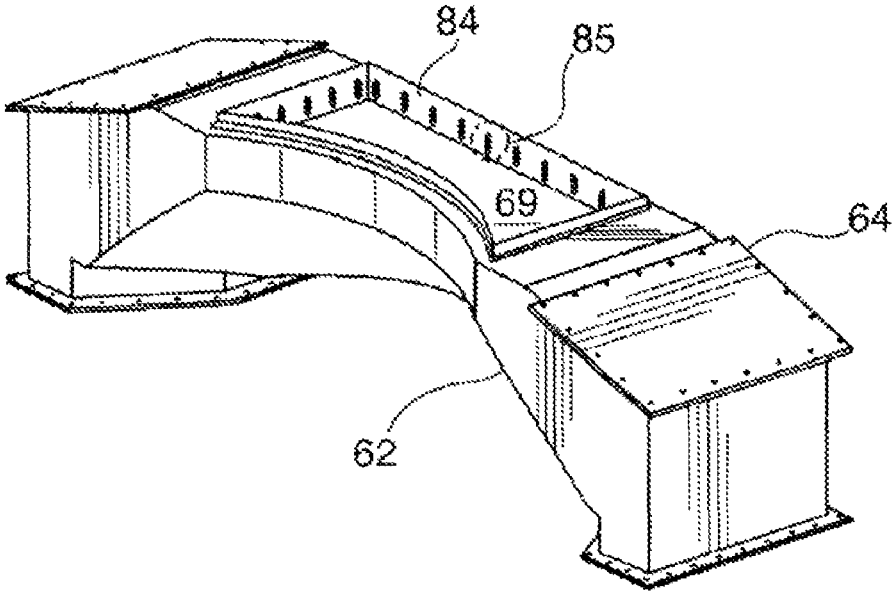

As shown in FIG. 8, the inlet opening 69 at the upper end 64 of the second conduit 62 may similarly be provided with an extension portion 84, either in addition to or as an alternative to extension portion 80. The extension portion 84 is bolted to the second conduit 62 around the perimeter of inlet opening 69, and is provided with slotted openings 85 to permit limited vertical movement of the extension portion 84.

After the transfer container 12 and the upper duct section 10 are moved into position as shown in FIGS. 3 and 4, the dampers 74 in branch conduits 70, 72 are opened and a negative pressure is created throughout the upper and lower duct sections 10, 52 by a dust collection fan (not shown). At this point the bottom opening 16 of the transfer container 12 is opened and its contents begin to empty. As the hot feed material 13 flows from the transfer container 12 to the feed bin 54, it displaces the air that was present in the partially filled feed bin 54. The air being displaced through opening 58 and the hot feed material 13 are necessarily forced to pass through each other. This rapid exchange of hot, reacting feed material with air in a highly agitated fashion causes an immediate release of a large amount of heat and an expansion of gases. These gases, and the dust which is entrained by them, are evacuated from the space enclosed by shroud 40 through the intake ports 46, entering the duct sections 10, 52 to be discharged into the main collection duct 68.

Furthermore, as the level of feed material 13 in the transfer container becomes lower (straight solid arrows in FIG. 3), atmospheric air is drawn into the top of the container. This air also reacts with the hot feed material to produce heat and expansion of gases, which may result in a positive gas pressure in the transfer container 12. These gases, and the dust which is entrained by them, are evacuated from the interior of the transfer container 12, lifting the sealing lid 32 out of engagement with the top opening 14, and then flowing through the duct sections 10, 52 and being discharged into the main collection duct 68.

During emptying of container 12, the amount of gas and dust removed through hood 28 may be considerably less than the amount of gas and dust removed through shroud 40. This is because gas is displaced from inside the feed bin 54 and flows into the header space defined by shroud 40, whereas air flows into the top opening 14 of transfer container 12 as the feed material is discharged. Depending partly on the reactivity of the feed material, there may be little or no pressure build-up in the container 12 during emptying of the feed material, in which case there will be little or no gas or dust emitted from the top opening 14 of the transfer container 12. In this situation, the dust collection system does not require a hood 28 or the portion of the first conduit 24 extending to the top opening 14 of the transfer container 12.

Figure 9:
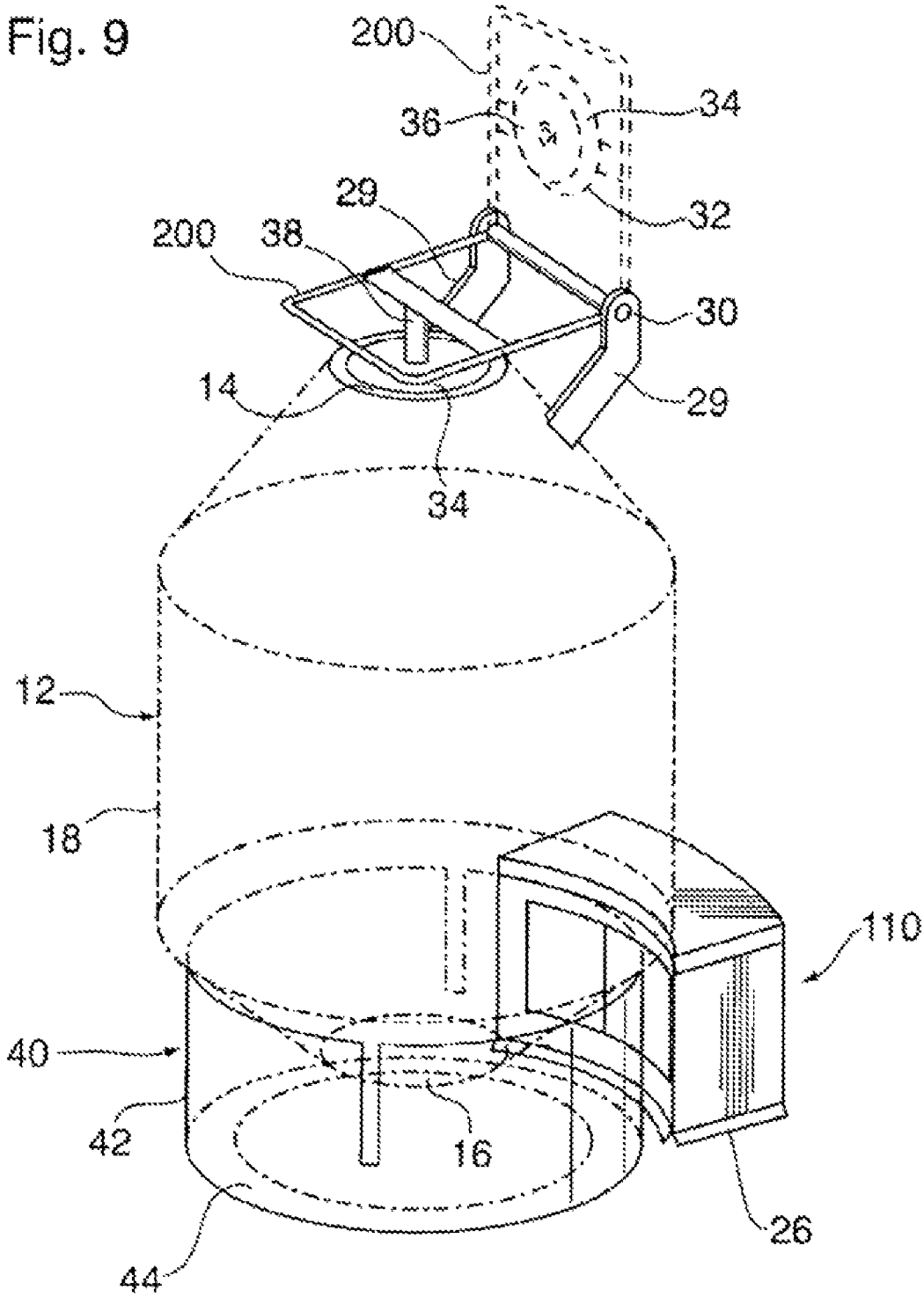
FIG. 9 illustrates an upper duct section of a dust collection system according to a first embodiment of the invention, shown in relation to a transfer container.

FIG. 9 illustrates a portion of a dust collection system according to a second embodiment of the invention, for use in situations where it is unnecessary to remove dust and gas emissions from the top opening 14 of transfer container 12. The dust collection system according to the second embodiment includes a number of components which are similar or identical to the components of the dust collection system according to the first embodiment. Therefore, the components of the dust collection system according to the second embodiment are identified by like reference numerals, and the above description of the elements of the first embodiment apply equally to like elements of the second embodiment.

FIG. 9 illustrates the upper duct section 110 of the dust collection system according to the second embodiment, along with transfer container 12 shown in dashed lines. The transfer container 12 has a top opening 14 located at its upper end, a bottom opening 16 located at its lower end, and a sidewall 18 extending between the upper and lower ends 14, 16. The sidewall 18 is shown as being tapered toward the top and bottom openings 14, 16. The dust collection system according to the second embodiment also includes a lower duct section 52 associated with a feed bin 54 and a main collection duct 68, and these elements are identical to the corresponding elements of the first embodiment, as illustrated in FIG. 2.

The upper duct section 110 of FIG. 9 is in close proximity to the transfer container 12 and comprises a first conduit 124 and a single dust collection fitting having one or more intake ports which are proximate to the bottom opening 16 of the transfer container 12. The first conduit 124 has an open end 126 located proximate to the lower end of the transfer container 12, the open end 126 being adapted to engage the upper end 64 of the second conduit 62 in the same manner described above with reference to the first embodiment.

The dust collection fitting of upper duct section 110 comprises a shroud 40 having a wall 42 with an open top end and an open bottom end. The shroud 40 is sealed along its open top end to the tapering portion of the sidewall 18 of transfer container 12, and the bottom end of wall 42 may have an inwardly extending flange 44 to seal against the top of the feed bin 54.

The wall 42 of shroud 40 has at least one intake port 46, and may have three intake ports as illustrated in FIGS. 6A and 6B. The intake ports 46 may be provided with grating 48 and adjustable cover plates 50. As in the first embodiment, the intake ports 46 provide communication between the interior of shroud 40 and the interior of first conduit 124.

The first conduit 124 may terminate immediately above the intake ports 46, and does not include a section extending upwardly to the top opening 14. The top opening 14 is, however, provided with a sealing lid 32 which comprises concentric discs 34, 36. The larger disc 34 comprises a sealing element which covers the top opening 14, while the smaller disc 36 is received inside the opening 14 and acts as a heat shield.

The discs 34, 36 are mounted on a link pin 38 which connects the discs 34, 36 to a frame 200 which is mounted to the transfer container 12 by connecting arms 29. The frame 200 is pivoted to the upward position (illustrated by dashed lines in FIG. 9) during filling of the transfer container 12, and pivoted down so that the opening 14 is closed by discs 34, 36 during transfer and emptying of container 12.

In use, the operation of the dust collection system of the second embodiment is substantially the same as the operation of the first embodiment, except that gases and dust will only be evacuated from the interior of shroud 40.

The system according to the invention can be applied to furnaces with a large number of feed bins and calcine containers or furnaces with as little as one feed bin and/or one calcine container. For example, in the case of large smelting furnaces with multiple feed bins and calcine containers, the system according to the invention may be affixed to all feed bin covers and all calcine containers.

Although the invention has been described with certain embodiments, it is not limited thereto. Rather, the invention includes all embodiments which may fall within the scope of the following claims.

What is claimed is:

1. A system for controlling emissions of gas and dust during transfer of a feed material from a transfer container to a feed bin of a furnace, comprising:

a first duct section located in close proximity to a side wall of the transfer container, the first duct section comprising a first conduit and a lower dust collection fitting, the lower dust collection fitting having a lower intake port which is proximate to a bottom opening of the transfer container, and the first conduit having an interior in communication with the lower intake port, and having an open end located proximate to the lower end of the transfer container;

a second duct section located in close proximity to the feed bin of the furnace, the second duct section comprising a second conduit having a inlet end with an inlet opening and an outlet end with an outlet opening;

wherein the inlet end of the second conduit is adapted to be in close proximity to the open end of the first conduit when the transfer container is in position to discharge said hot feed material into the feed bin, and with the inlet opening of the second conduit in communication with the open end of the first conduit, thereby forming a continuous gas flow passage from the lower intake port of the first duct section to the outlet end of the second duct section;

wherein the first duct section further comprises an upper dust collection fitting having an upper intake port located proximate to a top opening of the transfer container, said upper dust collection fitting comprising a hood which is pivotable between a first position in which the hood covers the top opening of the transfer container with the upper intake port in substantial alignment with the top opening, and a second position in which the hood is in a non-obstructing position relative to the top opening of the transfer container.

2. The system of claim 1, wherein the hood includes a sealing lid having a sealing element adapted to seal the top opening of the transfer container.

3. The system of claim 2, wherein the sealing lid further comprises a heat shield which shields the sealing element from the conditions inside the transfer container, wherein the sealing element is adapted to permit outflow of gas from inside the transfer container while substantially preventing inflow of gas into the container.

4. The system of claim 1, wherein the hood is pivotable about a horizontal axis located to one side of the top opening.

5. The system of claim 1, wherein a pivoting connection is provided between the hood and said first conduit.

6. The system of claim 1, wherein the lower dust collection fitting comprises a shroud having a wall with an open top end and an open bottom end, wherein the wall of the shroud surrounds the bottom opening of the transfer container and is adapted enclose a space between the transfer container and the feed bin when the transfer container is in position to discharge said hot feed material into the feed bin, wherein the intake port of the lower dust collection fitting formed in the wall of the shroud and is in communication with the interior of the first conduit.

7. The system of claim 6, wherein the wall of the shroud is cylindrical and is sealed along its open top end to the sidewall of the transfer container, and wherein the open bottom end is provided with an inwardly extending flange which is adapted to seal against an upper surface of the feed bin, said upper surface of the feed bin surrounding an inlet opening of the feed bin.

8. A system for controlling emissions of gas and dust during transfer of a feed material from a transfer container to a feed bin of a furnace, comprising:

a first duct section located in close proximity to a side wall of the transfer container, the first duct section comprising a first conduit and a lower dust collection fitting, the lower dust collection fitting having a lower intake port which is proximate to a bottom opening of the transfer container, and the first conduit having an interior in communication with the lower intake port, and having an open end located proximate to the lower end of the transfer container;

a second duct section located in close proximity to the feed bin of the furnace, the second duct section comprising a second conduit having a inlet end with an inlet opening and an outlet end with an outlet opening;

wherein the inlet end of the second conduit is adapted to be in close proximity to the open end of the first conduit when the transfer container is in position to discharge said hot feed material into the feed bin, and with the inlet opening of the second conduit in communication with the open end of the first conduit, thereby forming a continuous gas flow passage from the lower intake port of the first duct section to the outlet end of the second duct section;

wherein the lower dust collection fitting comprises a shroud having a wall with an open top end and an open bottom end, wherein the wall of the shroud surrounds the bottom opening of the transfer container and is adapted enclose a space between the transfer container and the feed bin when the transfer container is in position to discharge said hot feed material into the feed bin, wherein the intake port of the lower dust collection fitting formed in the wall of the shroud and is in communication with the interior of the first conduit; and wherein the shroud is provided with a plurality of said lower intake ports, and wherein each of the lower intake ports is provided with a grating.

9. The system of claim 8, wherein the open end of the first conduit is substantially coplanar with the bottom end of the shroud.

10. A system for controlling emissions of gas and dust during transfer of a feed material from a transfer container to a feed bin of a furnace, comprising:

a first duct section located in close proximity to a side wall of the transfer container, the first duct section comprising a first conduit and a lower dust collection fitting, the lower dust collection fitting having a lower intake port which is proximate to a bottom opening of the transfer container, and the first conduit having an interior in communication with the lower intake port, and having an open end located proximate to the lower end of the transfer container;

a second duct section located in close proximity to the feed bin of the furnace, the second duct section comprising a second conduit having a inlet end with an inlet opening and an outlet end with an outlet opening;

wherein the inlet end of the second conduit is adapted to be in close proximity to the open end of the first conduit when the transfer container is in position to discharge said hot feed material into the feed bin, and with the inlet opening of the second conduit in communication with the open end of the first conduit, thereby forming a continuous gas flow passage from the lower intake port of the first duct section to the outlet end of the second duct section;

wherein the lower dust collection fitting comprises a shroud having a wall with an open top end and an open bottom end, wherein the wall of the shroud surrounds the bottom opening of the transfer container and is adapted enclose a space between the transfer container and the feed bin when the transfer container is in position to discharge said hot feed material into the feed bin, wherein the intake port of the lower dust collection fitting formed in the wall of the shroud and is in communication with the interior of the first conduit;

wherein the wall of the shroud is cylindrical and is sealed along its open top end to the sidewall of the transfer container, and wherein the open bottom end is provided with an inwardly extending flange which is adapted to seal against an upper surface of the feed bin, said upper surface of the feed bin surrounding an inlet opening of the feed bin; and wherein the bottom end of the shroud is provided with a flange which seals against the upper surface of the feed bin.

11. A system for controlling emissions of gas and dust during transfer of a feed material from a transfer container to a feed bin of a furnace, comprising:

a first duct section located in close proximity to a side wall of the transfer container, the first duct section comprising a first conduit and a lower dust collection fitting, the lower dust collection fitting having a lower intake port which is proximate to a bottom opening of the transfer container, and the first conduit having an interior in communication with the lower intake port, and having an open end located proximate to the lower end of the transfer container;

a second duct section located in close proximity to the feed bin of the furnace, the second duct section comprising a second conduit having a inlet end with an inlet opening and an outlet end with an outlet opening;

wherein the inlet end of the second conduit is adapted to be in close proximity to the open end of the first conduit when the transfer container is in position to discharge said hot feed material into the feed bin, and with the inlet opening of the second conduit in communication with the open end of the first conduit, thereby forming a continuous gas flow passage from the lower intake port of the first duct section to the outlet end of the second duct section;

wherein the outlet end of the second conduit is connected to a main collection duct; and wherein the main collection duct extends alongside the feed bin in close proximity thereto, and wherein the second conduit extends vertically between its inlet end and its outlet end.

12. The system of claim 11, wherein the second conduit is divided into two or more branches, each of which extends vertically alongside the feed bin.

13. The system of claim 1, wherein the inlet end of the second conduit is substantially coplanar with a flat, planar surface surrounding an inlet opening of the feed bin which comes into engagement with the bottom end of the shroud when the transfer container is in position to discharge said hot feed material.

14. A system for controlling emissions of gas and dust during transfer of a feed material from a transfer container to a feed bin of a furnace, comprising:

a first duct section located in close proximity to a side wall of the transfer container, the first duct section comprising a first conduit and a lower dust collection fitting, the lower dust collection fitting having a lower intake port which is proximate to a bottom opening of the transfer container, and the first conduit having an interior in communication with the lower intake port, and having an open end located proximate to the lower end of the transfer container;

a second duct section located in close proximity to the feed bin of the furnace, the second duct section comprising a second conduit having a inlet end with an inlet opening and an outlet end with an outlet opening;

wherein the inlet end of the second conduit is adapted to be in close proximity to the open end of the first conduit when the transfer container is in position to discharge said hot feed material into the feed bin, and with the inlet opening of the second conduit in communication with the open end of the first conduit, thereby forming a continuous gas flow passage from the lower intake port of the first duct section to the outlet end of the second duct section; and wherein the first duct section and/or the second duct section are constructed so as to leave a gap between the open end of the first conduit and the inlet opening of the second duct section.

15. The system of claim 14, wherein the gap has a size of less than about 1 inch.

16. The system of claim 14, wherein one or both of the first duct section and the second duct section are provided with an extension portion to adjust the size of the gap.

* * * * *

UNITED STATES PATENT AND TRADEMARK OFFICE

CERTIFICATE OF CORRECTION

PATENT NO. : 8,298,476 B2
APPLICATION NO. : 13/249445
DATED : October 30, 2012
INVENTOR(S) : Sean David Southall et al.

It is certified that error appears in the above-identified patent and that said Letters Patent is hereby corrected as shown below:

In the Claims:

Column 9, Line 52, Claim 1, “a inlet” should read --an inlet--;
Column 10, Line 23, Claim 6, “adapted enclose” should read --adapted to enclose--;
Column 10, Line 50, Claim 8, “a inlet” should read --an inlet--;
Column 10, Lines 64-65, Claim 8, “adapted enclose” should read --adapted to enclose--;
Column 11, Line 24, Claim 10, “a inlet” should read --an inlet--;
Column 11, Lines 38-39, Claim 10, “adapted enclose” should read --adapted to enclose--;
Column 12, Line 3, Claim 11, “a inlet” should read --an inlet--; and
Column 12, Line 44, Claim 14, “a inlet” should read --an inlet--.

Signed and Sealed this
Eighteenth Day of June, 2013

Teresa Stanek Rea
*Acting Director of the United States Patent and Trademark Office*